US006813779B1

(12) United States Patent
Williams

(10) Patent No.: US 6,813,779 B1
(45) Date of Patent: Nov. 9, 2004

(54) ARM PROTECTOR

(76) Inventor: Chris Williams, 1302 Massachusetts Ave., Beaumont, CA (US) 92223

( * ) Notice: Subject to any disclaimer, the term of this patent is extended or adjusted under 35 U.S.C. 154(b) by 0 days.

(21) Appl. No.: 10/794,347

(22) Filed: Mar. 4, 2004

(51) Int. Cl.[7] ..... A41D 13/00
(52) U.S. Cl. ..... 2/16
(58) Field of Search ..... 2/16, 20, 22, 24, 2/59, 61, 91, 123, 242, 270, 124–126, 207, 208, 174, 202, 911, 917, 918, 60, 170, 268; 602/3, 21, 61–64

(56) References Cited

U.S. PATENT DOCUMENTS 3,657,741 A * 4/1972 Blanco ..... 2/59
4,785,478 A 11/1988 Mosley
4,967,419 A 11/1990 Elliott
D313,674 S 1/1991 Sharpe
5,056,157 A 10/1991 Pryor
5,357,633 A 10/1994 Rael
5,628,062 A 5/1997 Tseng
5,638,546 A * 6/1997 Vita ..... 2/16
6,405,381 B1 * 6/2002 Bowman, Jr. ..... 2/170
6,449,772 B1 * 9/2002 Donner ..... 2/170
6,665,876 B1 * 12/2003 Newman ..... 2/59

* cited by examiner

*Primary Examiner*—Tejash Patel
(74) *Attorney, Agent, or Firm*—Lawrence J. Gibney, Jr.

(57) ABSTRACT

This device protects the arm of a driver or a passenger, which is exposed to sun. It will also serve to protect the exposed arm from flying debris. It is made from elastic material and because of its elastic quality will fit snugly on any arm.

2 Claims, 3 Drawing Sheets

ARM PROTECTOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to the protection of the arm of A driver or passenger, which is exposed to direct sunlight particularly on long trips. The device is a sleeve, which is inserted over the exposed arm.

B. Prior Art

There are several other arm protective garments, which form part of the prior art. One of the problems with the prior art are the ease by which the devices are inserted over the arm and the area which is covered.

Examples of the prior art include Rael, U.S. Pat. No. 5,357,633. The Rael device is inserted over the person's neck while this device is easily pulled on and off across the forearm to the upper arm. The Rael device covers a different area in that this device can be easily slid over the entire arm and includes an insert for the thumb hole.

Another example of the prior art is Tseng, U.S. Pat. No. 5,628,062, which is a UV protection sleeve. The device in Tseng loosely covers the entire arm including the hand.

A third example is Elliott, U.S. Pat. No. 4,967,419 which is a device that is used for many different purposes including anyone who works outdoors.

BRIEF SUMMARY OF THE INVENTION

On particularly long road trips in cars or other conveyances the arm of the driver or passenger which is closest to the window and therefore likely to be exposed to sunlight may become burned due to exposure over a long period of time.

It is the object of this device to protect that exposed arm by providing a cover for the arm from the wrist to the biceps area.

The device will be made of elastic material so that the device can be easily slipped on or slipped off and also provide a snug tight fit to the user's arm.

The device will be of many different colors and should be made of material which is elastic so that it would comfortably fit the arms of any adult or child.

Although it will protect primarily against the sun it will also protect the arm from debris on the road, which may be kicked up by passing motorists.

DETAILED DESCRIPTION OF THE EMBODIMENT

First Embodiment

Figure 1:
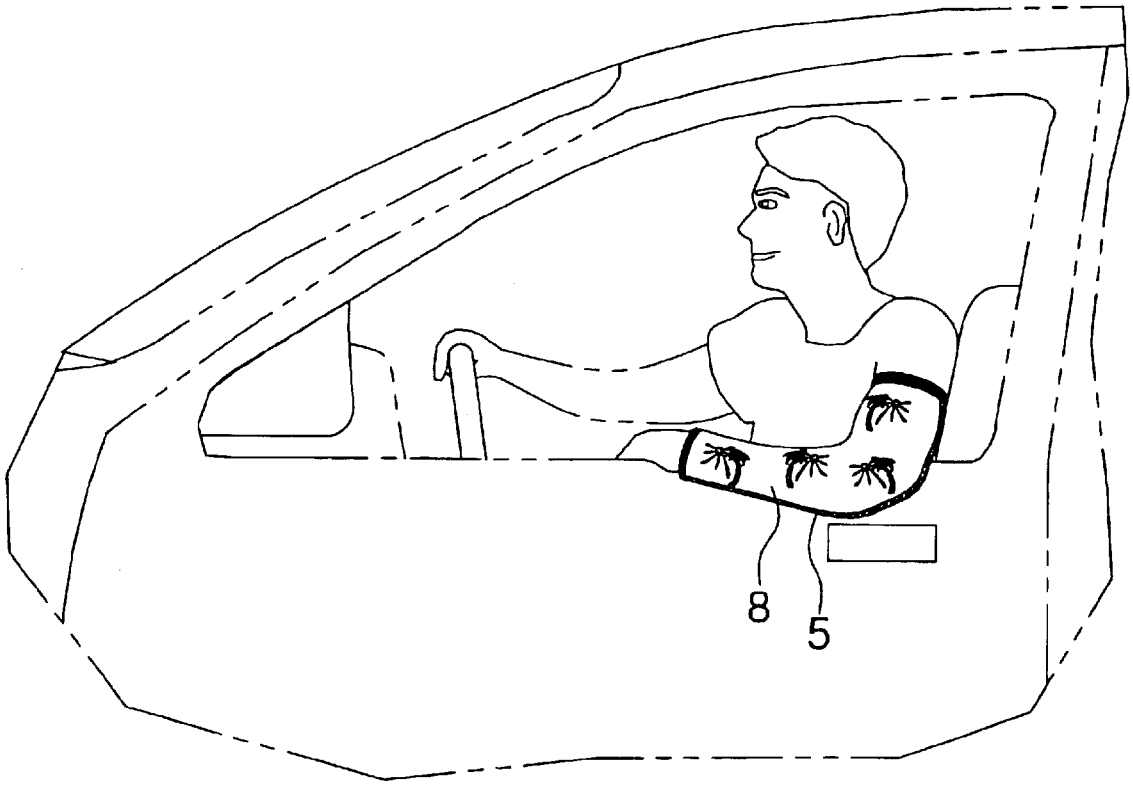
FIG. 1 is a perspective view of the device on a person's arm.

According to FIG. 1 this device will be used as a shield to protect a driver's left arm from damage from the sun and/or debris. Alternatively, it could also be used to protect a passenger's arm.

It would fit tightly or snugly around the arm of the individual from the top of the wrist to the middle of the bicep section of the arm. (FIG. 1)

Figure 2:
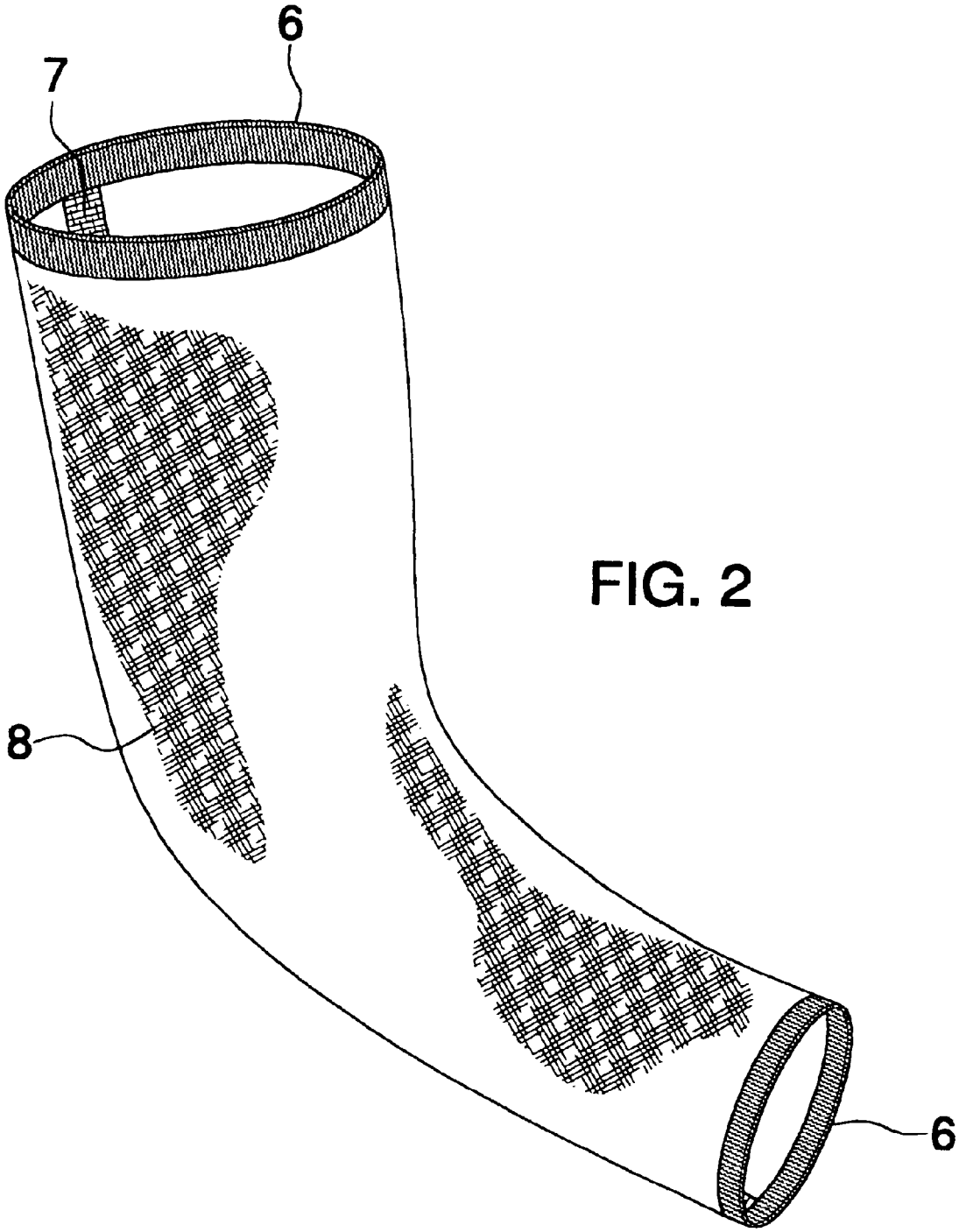
FIG. 2 is a perspective view of the parts of the invention.

FIG. 2 shows the parts of the device. This device will be made using elastic bands 6, expansion mesh 7 and a fabric sleeve 8. Because the device would be made from elastic material and elastic bands and the first and second side of the device, the device would achieve a tight fit and would fit any size arm.

The arm of the individual would fit within the elastic band 6. The device has two ends, a first end near the person's arm near biceps region and through which the arm is inserted into the device and the second end at the area of the person's wrist. (FIG. 2)

The device should be constructed of expansion mesh 7 to allow the device to be inserted over the person's arm and yet have a snug fit. (FIG. 1) The use of expansion mesh would allow the device to be used on a variety of different sized arms. The sleeve fabric would provide a sun shield and a shield from flying debris.

Figure 3:
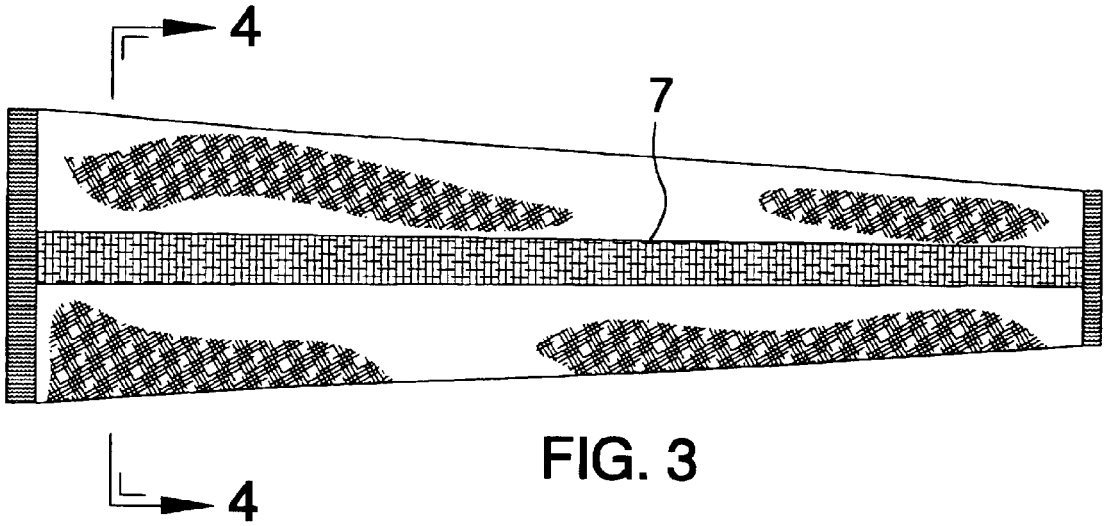
FIG. 3 is a view from the bottom of the device.
Figure 4:
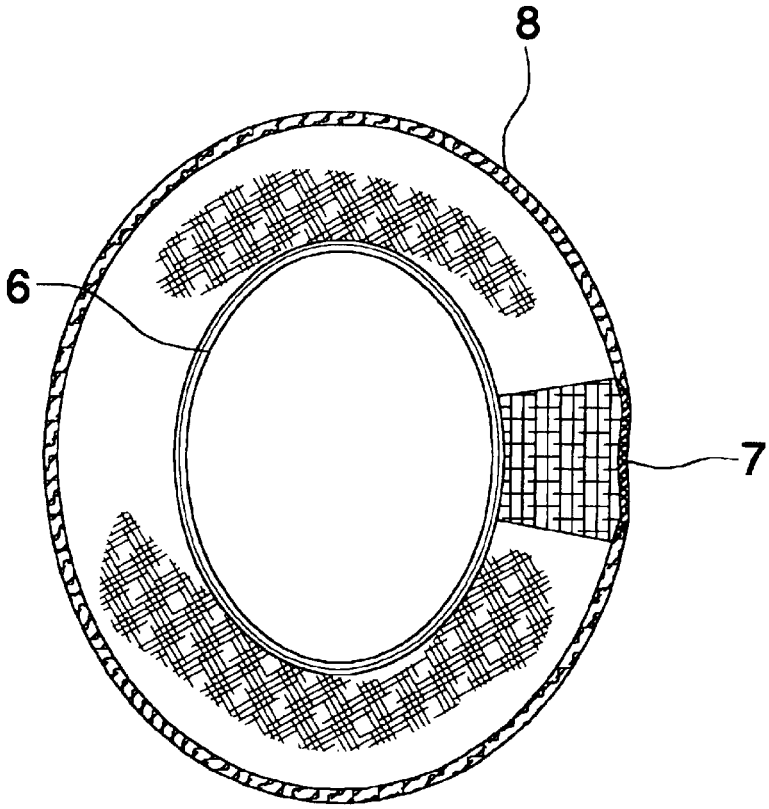
FIG. 4 is a cross sectional view according to line 4—4 on FIG. 3.

FIG. 3 is a bottom view of the device which shows the strip of expansion mesh 7 on both the first end and second end of this device. The expansion mesh 7 would extend the entire length of the device. FIG. 4 is a cross section showing a circular ring surrounded by sleeve fabric 8, expansion mesh 7, and the elastic band 6.

Different sizes will be made depending on the size of the arm to be protected would also be anticipated that these devices will be made for children as well.

Second Embodiment

Although the device as represented by the drawings depicts the use on a driver's left arm it is contemplated that is will also be used to protect the right arm of the passenger in the front seat. It will also be used to protect any passenger on any side of the vehicle.

While the embodiments of the invention have been disclosed, certain modifications may be made by those skilled in the art to modify the invention without departing from the spirit of the invention.

What is claimed is:

1. A device to protect the left arm of the driver of a vehicle which is comprised of flexible material in the shape of a circular band, sleeve fabric, and expansion mesh;

wherein the arm of the individual is inserted through the circular elastic band;

wherein the device covers from the approximate middle of the biceps to the point where the wrist is connected to the arm;

wherein the elastic bands are joined to the sleeve fabric and expansion mesh.

2. A device to protect the right arm of a passenger of the front seat which is comprised of flexible material in the shape of circular band, sleeve fabric, and expansion mesh;

wherein the arm of the individual is inserted through the circular elastic bands;

wherein the device covers from the approximate middle of the biceps to the point where the wrist is connected to the arm;

wherein the elastic bands are joined to the sleeve fabric and expansion mesh.

* * * * *